US008135592B2

(12) United States Patent
Matsumoto

(10) Patent No.: US 8,135,592 B2
(45) Date of Patent: Mar. 13, 2012

(54) SPEECH SYNTHESIZER

(75) Inventor: Chikako Matsumoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 880 days.

(21) Appl. No.: 11/494,476

(22) Filed: Jul. 28, 2006

(65) Prior Publication Data

US 2007/0233492 A1 Oct. 4, 2007

(30) Foreign Application Priority Data

Mar. 31, 2006 (JP) ..... 2006-097331

(51) Int. Cl.
*G10L 13/08* (2006.01)

(52) U.S. Cl. ..... 704/260; 704/235; 704/258; 704/261; 704/271

(58) Field of Classification Search ..... None
See application file for complete search history.

(56) References Cited

U.S. PATENT DOCUMENTS

| | | | | |
|---|---|---|---|---|
| 5,463,713 | A * | 10/1995 | Hasegawa | 704/260 |
| 6,405,169 | B1 * | 6/2002 | Kondo et al. | 704/258 |
| 6,470,316 | B1 * | 10/2002 | Chihara | 704/267 |
| 2004/0019484 | A1 * | 1/2004 | Kobayashi et al. | 704/258 |
| 2005/0119889 | A1 * | 6/2005 | Yamazaki | 704/259 |
| 2005/0171778 | A1 | 8/2005 | Sasaki et al. | |
| 2005/0261905 | A1 | 11/2005 | Pyo et al. | |
| 2006/0136214 | A1 * | 6/2006 | Sato | 704/265 |

FOREIGN PATENT DOCUMENTS

| | | |
|---|---|---|
| EP | 0 427 485 | 8/1996 |
| JP | 08-083095 | 3/1996 |
| JP | 09-160582 | 6/1997 |
| JP | 10-274999 | 10/1998 |
| JP | 2000-075882 | 3/2000 |
| JP | 2000-267687 | 9/2000 |
| JP | 2005-189313 A | 7/2005 |

OTHER PUBLICATIONS

European Search Report in corresponding European Patent Application No. 06016106.4-2218 dated Nov. 17, 2006.

* cited by examiner

*Primary Examiner* — Leonard Saint Cyr
(74) *Attorney, Agent, or Firm* — Fujitsu Patent Center

(57) ABSTRACT

The present invention relates to a technology capable of providing a hearer with an easy-to-hear synthetic speech to the hearer. The speech synthesizer includes an input unit receiving an input of a sentence, a generation unit generating synthetic speech data from the sentence inputted to the input unit, an accumulation unit accumulating the sentence inputted to the input unit, a collation unit acquiring, when a sentence is newly inputted to the input unit, a collation target sentence that should be collated with this new sentence from the accumulation unit, and calculating a variation degree of the new sentence from the collation target sentence through the collation between the new sentence and the collation target sentence, a calculation unit calculating a variation coefficient corresponding to the variation degree, and a correction unit correcting the synthetic speech data with the variation coefficient.

13 Claims, 12 Drawing Sheets

FIG. 7

FIG. 8

| | b=1 | b=2 | b=3 | b=4 | b=5 | b=6 |
|---|---|---|---|---|---|---|
| t(n=1)=1 | KYOU NO | TOHOKU | CHIHOU NO | TENKI WA | HARE | DESU |
| t(n=2)=2 | KYOU NO | KANTO | CHIHOU NO | TENKI WA | HARE | DESU |
| t(n=3)=3 | KYOU NO | TOKAI | CHIHOU NO | TENKI WA | KUMORI TOKIDOKI AME | DESU |
| t(n=4)=4 | ASU NO | KANSAI | CHIHOU NO | TENKI WA | HARE | DESU |
| t(n=5)=5 | ASU NO | KANSAI | CHIHOU NO | SAITEIKION WA | JUDO | DESU |
| v(n, b) | 0.5 | 1.08 | 0 | 1 | 1.83 | 0 |
| C1(n, b) | 0.95 | 1.08 | 0.85 | 1.06 | 1.25 | 0.85 |

FIG. 9

| | b=1 | b=2 | b=3 | b=4 | b=5 | b=6 |
|---|---|---|---|---|---|---|
| t(4)−t(1)=48 | KYOU NO | TOHOKU | CHIHOU NO | TENKI WA | HARE | DESU |
| t(4)−t(2)=35 | KYOU NO | KANTO | CHIHOU NO | TENKI WA | HARE | DESU |
| t(4)−t(3)=20 | KYOU NO | TOKAI | CHIHOU NO | TENKI WA | KUMORI TOKIDOKI AME | DESU |
| t(4)−t(4)= 0 | ASU NO | KANSAI | CHIHOU NO | TENKI WA | HARE | DESU |
| y(n, b) | 1.28 | 1.28 | 0 | 0 | 0.67 | 0 |
| c1(n, b) | 1.24 | 1.24 | 0.85 | 0.85 | 1.05 | 0.85 |

| PHONEME NAME | PHONEME LENGTH (msec) | VOLUME (RELATIVE VALUE) |
|---|---|---|
| Q | 40 | 0 |
| a | 114 | 2690 |
| s | 132 | 1400 |
| u | 54 | 2650 |
| n | 48 | 2830 |
| o | 146 | 2910 |
| Q | 260 | 0 |
| k | 45 | 1800 |
| a | 87 | 2760 |
| n | 110 | 2100 |
| ⋮ | ⋮ | ⋮ |
| d | 45 | 900 |
| e | 110 | 2510 |
| s | 90 | 1820 |
| u | 37 | 1500 |
| Q | 760 | 0 |

SPEECH SYNTHESIZER

BACKGROUND OF THE INVENTION

1. Field of the Invention

The present invention relates to a speech synthesizer.

2. Description of the Related Art

A speech uttered by a person has a speed variation according to contents of the speech uttered. This speed variation indicates where the speaker would emphasize. Further, this speed variation is associated with how much the hearer gets easy to hear. Accordingly, control of prosodemes of a speech speed, a volume, a pitch, etc is a technology necessary for generating the easy-to-hear synthetic speech.

Moreover, there is an instance in which almost the same sentences continue as in the case of a voice guidance, a weather forecast, etc. For example, there is a case of continuation of sentences vocalized by the speech synthesizer, such as [Today's weather in the Hokkaido region is fair.] ([kyou no Hokkaido chihou no tenki wa hare desu.]), [Today's weather in the Tohoku region is fair.] ([kyou no Tohoku chihou no tenki wa hare desu.]), [Today's weather in the Kanto region is cloudy.] ([kyou no Kanto chihou no tenki wa kumori desu.]), . . . [Today's weather in the Kyushu region is cloudy.] ([kyou no Kyushu chihou no tenki wa kumori desu.]). When the speech synthesizer vocalizes such sentences in a monotone, the hearer might feel a stress in some cases. Further, in the case of the speech in monotone, the hearer can not concentrate on a want-to-hear point in the speech and might fail to hear the want-to-hear point.

Patent document 1 ("Japanese Patent Application Laid-Open Publication No.9-160582") discloses a speech synthesizing technology of controlling a speed of the synthetic speech by inserting a speed control symbol in between paragraph boundaries delimited as a result of analyzing a text as by a morphological analysis when desiring to change the speech speed.

Patent document 2 ("Japanese Patent Application Laid-Open Publication No.2000-75882") discloses the speech synthesizing technology of controlling the speed of the synthetic speech by inserting (the speed control symbol) in between each mora (which are defined based on a unit as a plurality of speech syllables structuring character information) delimited as a result of analyzing the text as by the morphological analysis when desiring to change the speech speed.

Patent document 3 ("Japanese Patent Application Laid-Open Publication No.8-83095") discloses a speech speed control technology based on changing a length of a silence interval between breath groups. This technology involves executing a process of expanding the silence interval, extending a pitch interval and repeating the pitch interval.

Further, Patent document 4 ("Japanese Patent Application Laid-Open Publication No.2000-267687") discloses a technology of reading sentences in a way that skips the sentences exhibiting a low degree of importance.

A technology of Patent document 5 ("Japanese Patent Application Laid-Open Publication No.10-274999") is that a keyword is extracted from a title and a summary in order to search for an important phrase in the sentence. Then, in this technology, it is judged whether or not the extracted keyword is contained in the sentence concerned. This technology involves controlling the speech speed etc to make an output speech distinguishable in accordance with a result of the judgment.

In the technologies of the Patent documents 1 and 2, the synthetic speech having a desired speed can be generated by inserting the speed control signals in between the group paragraphs and in between the each mora. In the technologies of the Patent documents 1 and 2, however, it is required that the speech speed control signal be manually changed for attaining the desired speech speed. Therefore, this operation needs manpower. Further, if an order of the sentences is not set beforehand in the speech synthesizer, a problem arises, wherein the speech speed can not be changed from time to time.

In the speech speed control technology (Patent document 3) of changing the length of the silence interval between the breath groups, it might happen that a result of the silence interval being short and a result of non-existence of the silence interval are outputted. Due to these drawbacks, such a problem occurs that prosodemes are disordered, and the hearer, when hearing such a synthetic speech, might hear like getting choked in breathing.

In the technology (the technology of Patent document 4) of controlling the speech utterance time by skipping (the sentences), the whole speech utterance time can be reduced. A problem is, however, such that this technology can not be applied to a case of having the necessity of reading all the sentences without any deletion as in the case of the sentences for the voice guidance.

In the speech speed control technology (the technology of Patent document 5) using the keyword, a problem is that the keyword does not invariably indicate the important phrase of the sentence to be read. For instance, in the example of the weather forecast described above, if the weather is the keyword, in a case where the same weather continues such as. [Today's weather in the Tohoku region is fair.] ([kyou no Tohoku chihou no tenki wa hare desu.]) and [Today's weather in the Kanto region is fair.] ([kyou no Kanto chihou no tenki wa hare desu.]), a different phrase (e.g., a date and a name of the region) might be more important to the hearer than the phrase corresponding to the weather. In the conventional technologies, however, the speech synthesizer changes the phrase corresponding to the keyword, and hence there arises such a problem that the speech speed of the phrase important to the hearer is not changed. Further, in this technology, the weather, the date and the name of the region are registered as the keywords, and, when the sentences containing these keywords are consecutively outputted as the speeches from the speech synthesizer, a problem is that there is no difference between the sentences outputted as the speeches. Hence, another problem of this technology arises, wherein the phrase desired most to be heard by the hearer can not be emphasized.

SUMMARY OF THE INVENTION

It is an object of the present invention to provide a technology capable of providing the hearer with the easy-to-hear synthetic speech to the hearer.

The present invention adopts the following means in order to solve the above mentioned problems.

Namely, a speech synthesizer according to the present invention comprises an input unit receiving an input of a sentence, a generation unit generating synthetic speech data from the sentence inputted to the input unit, an accumulation unit accumulating the sentence inputted to the input unit, a collation unit acquiring, when a sentence is newly inputted to the input unit, a collation target sentence that should be collated with this new sentence from the accumulation unit, and calculating a variation degree of the new sentence from the collation target sentence through the collation between the new sentence and the collation target sentence, a calculation unit calculating a variation coefficient corresponding to the variation degree, and a correction unit correcting the synthetic speech data with the variation coefficient.

The present invention can be actualized as a synthetic speech generation method having the same features as those of the speech synthesizer described above.

According to the present invention, the hearer can be provided with the easy-to-hear synthetic speech to the hearer.

BRIEF DESCRIPTION OF THE DRAWINGS

FIG. 7 is an explanatory diagram of the mode of [collation with all of collating target sentences] according to the embodiment of the present invention;

FIG. 8 is an explanatory diagram of a first calculation example of a variation degree according to the embodiment of the present invention;

FIG. 9 is an explanatory diagram of a second calculation example of the variation degree according to the embodiment of the present invention;

DESCRIPTION OF THE PREFERRED EMBODIMENTS

A speech synthesizer in an embodiment of the present invention will hereinafter be described with reference to the drawings. A configuration in the following embodiment is an exemplification, and the present invention is not limited to the configuration in the embodiment.

Configuration of Speech Synthesizer

Figure 1:
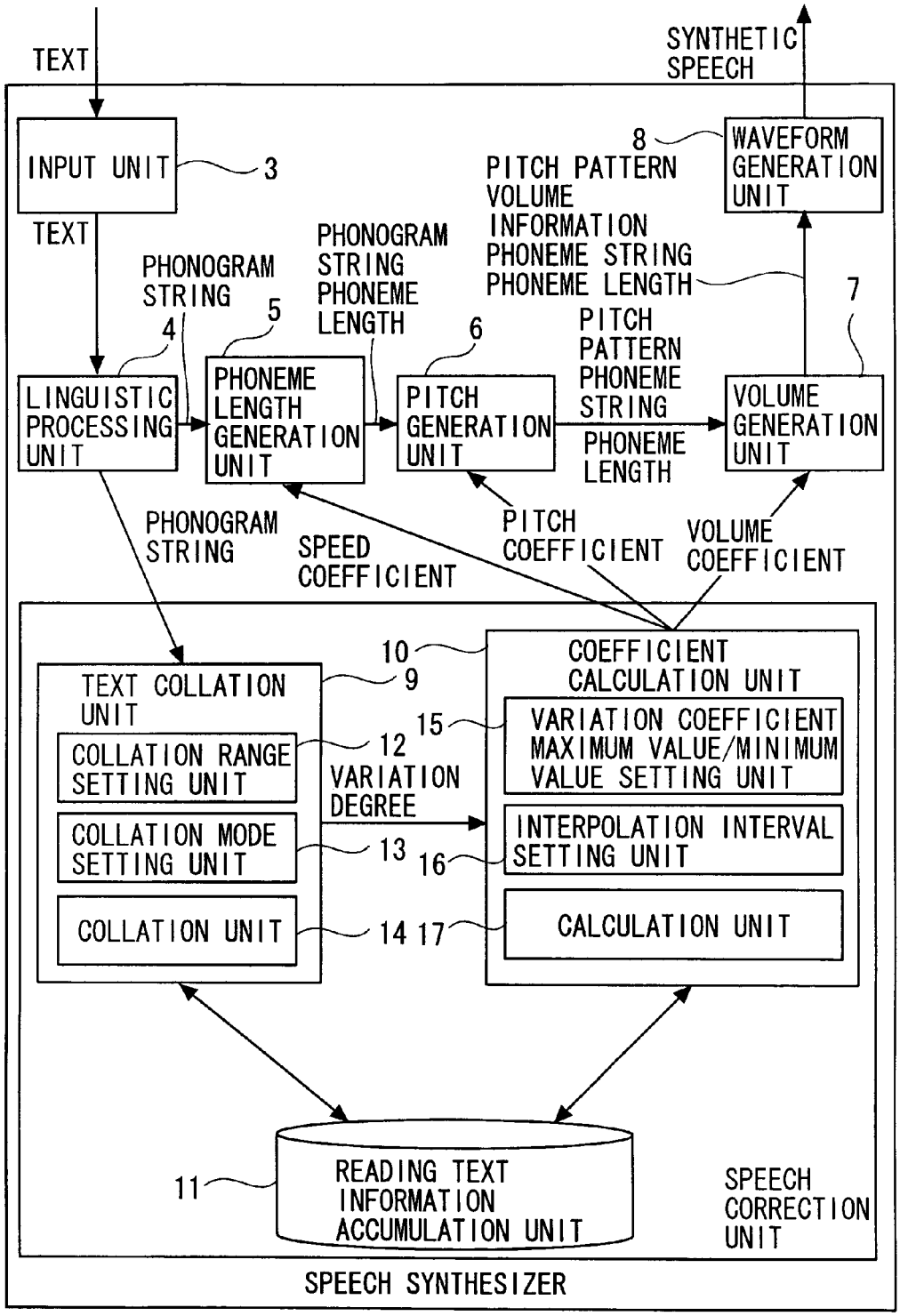
FIG. 1 is a diagram of a basic configuration of a speech synthesizer in an embodiment of the present invention.

FIG. 1 is a diagram showing a basic configuration of a speech synthesizer 1 in the embodiment. The speech synthesizer 1 includes a speech correction unit 2, an input unit 3, a linguistic processing unit 4, a phoneme length generation unit 5, a pitch generation unit 6, a volume generation unit 7 and a waveform generation unit 8. The speech synthesizer 1 can be actualized by use of a hard disc (storage device) storing a program for executing processes in the embodiment executed, a central processing unit (CPU) that executes this program and a computer (information processing device) having a memory employed for temporarily storing information, and the configuration described above is a function actualized in such a way that the CPU loads the program stored in the hard disc into the memory and executes this program.

The input unit 3 accepts text data of a sentence for generating a synthetic speech. The linguistic processing unit 4, the phoneme length generation unit 5, the pitch generation unit 6, the volume generation unit 7 and the waveform generation unit 8 operate as a synthetic speech generation unit that generates the synthetic speech from the text data inputted to the input unit 3.

The linguistic processing unit 4 executes a morphological analysis about the text (sentence) and segments this text (sentence) into morphemes (the minimum unit having a meaning in language). The linguistic processing unit 4 determines reading and an accent of each of the segmented morphemes. The linguistic processing unit 4 detects a phrase from a string of the morphemes. The linguistic processing unit 4 analyzes a dependency relation between the respective phrases that are detected, and outputs a result of this analysis as a phonogram string defined as a sentence that is segmented into a plurality of words (phrase) and contains katakana characters representing the reading, accent information and symbols representing prosodeme.

The phoneme length generation unit 5 generates a phoneme length from the phonogram string generated by the linguistic processing unit 4. At this time, the phoneme length generation unit 5 corrects (weighting) the phoneme length by use of a speed coefficient generated by the speech correction unit 2.

The pitch generation unit 6 generates a pitch pattern and a phonemic string from the phonogram string by a predetermined method. For example, the pitch generation unit 6 generates the pitch pattern by overlapping a phrase element gently descending from a head of breath group down to a tail of breath group with an accent element locally rising in its frequency (which is the generation based on Fujisaki Model). At this time, the pitch generation unit 6 corrects the pitch pattern by using the pitch coefficient generated by the speech correction unit 2.

The volume generation unit 7 generates volume information from the phonemic string and from the pitch pattern. The volume generation unit 7 corrects the thus-generated volume information by using the volume coefficient generated by the speech correction unit 2.

The phoneme length generation unit 5, the pitch generation unit 6 and the volume generation unit 7 make, only when assigned a variation coefficient, the correction by use of the assigned variation coefficient. Control of whether the speech correction unit 2 assigns the variation coefficient to the phoneme length generation unit 5, the pitch generation unit 6 and the volume generation unit 7, can be actualized by setting a setup flag utilizing, e.g., a user interface.

The waveform generation unit 8 generates a synthetic speech from the phoneme length, the phoneme string, the pitch pattern and the volume information by a predetermined method, and outputs the synthetic speech.

The speech correction unit 2 accumulates the phonogram strings (sentences) acquired from the text data inputted by the input unit 3, then obtains a variation degree, when a new phonogram string (sentence) is inputted, of this new sentence through collation between the new sentence and the accumulated sentences, subsequently calculates the variation coefficient corresponding to this variation degree, and assigns this variation coefficient to the synthetic speech generation unit. The synthetic speech generation unit corrects the synthetic speech by use of the variation coefficient.

The speech correction unit 2 has a text collation unit 9, a coefficient calculation unit 10, and a reading text information accumulation unit 11 (which will hereinafter simply be referred to as the [accumulation unit 11]). The text collation unit 9 stores the phonogram string inputted from the linguistic processing unit 4 in the accumulation unit 11. Further, the text collation unit 9 executes a process of collating the phonogram string (the new phonogram string) inputted from the linguistic processing unit 4 with the phonogram string accumulated in the accumulation unit 11, thereby calculating the variation degree between these two phonogram strings.

To be specific, the text collation unit 9 includes a collation range setting unit 12, a collation mode setting unit 13 and a collation unit 14. The collation range setting unit 12 retains a setting content of a collation range that is inputted by using, e.g., the user interface. The collation range defines a range of the phonogram strings (sentences: accumulated in the accumulation unit 11) to be collated with the new phonogram string (sentence) inputted from the linguistic processing unit 4. In the present embodiment, one of a [the number of sentences] and [time] when the past text (sentence) was uttered (which is, e.g., the [time] tracing the sentences back from the input of the new phonogram string (sentence)) is designated as the collation range.

The collation mode setting unit 13 retains a setting content (which is inputted by using, e.g., the user interface) of the collation mode that specifies what kind of mode the collation between the phonogram strings (sentences) is conducted in. Prepared as the collation modes in the present embodiment are a mode of [collating with just anterior sentence](a first collation mode) of collating a certain sentence with a sentence just anterior to this former sentence (the new sentence is collated with at least the sentence (accumulated in the accumulation unit 11 and contained in the collation range) inputted just anterior to this new sentence and a mode of [collating with all collating target sentences](a second collation mode) of collating the new sentence with each of the sentences contained in the collation range (the sentences accumulated in the accumulation unit 11).

The collation unit 14, when the new sentence (the phonogram string) is inputted, reads from the accumulation unit 11 the sentence contained in the collation range set by the collation range setting unit 12, then collates the readout sentence with the new sentence according to the collation mode set in the collation mode setting unit 13, subsequently calculates the variation degree between the sentences, and assigns the calculated variation degree to the coefficient calculation unit 10.

The accumulation unit 11 assigns input or accumulation time and identification information (input number) representing an input order to the sentence (the phonogram string) inputted to the input unit 3, and accumulates these items of information. Namely, the accumulation unit 11 accumulates the sentence, the input or accumulation time of this sentence and the input order thereof in a way that associates these items of information with each other.

The coefficient calculation unit 10 calculates the variation coefficient (which is a coefficient for correcting the synthetic speech generated by the synthetic speech generation unit) corresponding to the variation degree assigned from the text collation unit 9 (the collation unit 14). The coefficient calculation unit 10 calculates, as the variation coefficients, a speed coefficient of a speech speed, a pitch coefficient and a volume coefficient. The speed coefficient is used for correcting the phoneme length generated by the phoneme length generation unit 5, the pitch coefficient is used for correcting the pitch pattern generated by the pitch generation unit 6, and the volume coefficient is used for correcting the volume information generated by the volume generation unit 7. The variation coefficient is calculated for every plural parts (e.g., the phrases) structuring the phonogram string.

The coefficient calculation unit 10 includes a variation coefficient maximum value/minimum value setting unit 15, an interpolation interval setting unit 16 and a calculation unit (coefficient setting unit) 17.

The variation coefficient maximum value/minimum value setting unit 15 retains a maximum value and a minimum value of the variation coefficient calculated by the calculation unit 17. Values inputted by use of, e.g., the user interface are retained as the maximum value and the minimum value by the setting unit 15.

The interpolation interval setting unit 16, if there is no silence interval (short pause: SP) in variation parts in the sentence that are distinguishable from the variation coefficients, retains an interpolation interval as a period of time for which to gently change the phoneme length, the pitch and the volume. The interpolation interval is on the order of, e.g., 20 [msec] and is inputted through, e.g., the user interface. A value specified as the interpolation interval is set.

The calculation unit 17 calculates the variation coefficients (the speed coefficient, the pitch coefficient and the volume coefficient) by use of the variation degree obtained from the collation unit 14 and the maximum value and the minimum value of the variation coefficient. The calculation unit 17 assigns the speed coefficient to the phoneme length generation unit 5, assigns the pitch coefficient to the pitch generation unit 6 and assigns the volume coefficient to the volume generation unit 7.

Further, the calculation unit 17 judges whether the interpolation interval is provided or not, and, in the case of providing the interpolation interval, assigns the information of the interpolation interval to the phoneme length generation unit 5, the pitch generation unit 6 and the volume generation unit 7. The phoneme length generation unit 5, the pitch generation unit 6 and the volume generation unit 7, when receiving the information of the interpolation interval, adjust the phoneme length, the pitch and the volume so that the phoneme length, the pitch and the volume gently change within the time specified as the interpolation interval.

User Interface

Given next is an explanation of the user interface for setting the collation range, the collation mode, the maximum value and the minimum value of the variation coefficient and the interpolation interval in the configuration of the speech correction unit 2 shown in FIG. 1. The speech synthesizer 1 is connected to the input device and the output device (display device), wherein the display device displays an input screen (window) used for the user to input the information described above. The user can input the should-be-set information to the input screen by using the input device.

Figure 2:
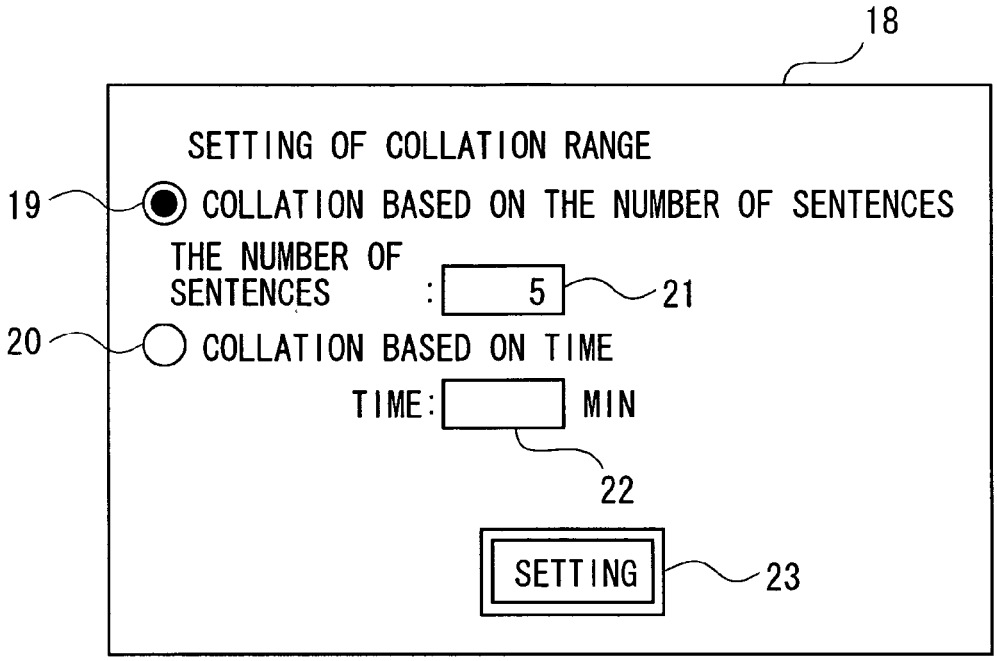
FIG. 2 is a diagram showing a collation method setting window according to the embodiment of the present invention.

FIG. 2 shows a collation range setting window 18 for setting the collation range. The collation range setting window 18 is set up by the collation range setting unit 12 so as to be displayed on the display device (unillustrated) connected to the collation range setting unit 12. Further, the collation range setting unit 12 accepts an input, given by the user, to the collation range setting window 18 through the input device (not shown) connected to the collation range setting unit 12.

The collation range setting window 18 has a selection button 19, a selection button 20, a sentence count input field 21, a time input field 22 and a setting button 23. An assumption is that the user chooses the selection button 19 (a button for specifying the [collation based on the number of sentences]), then inputs the number of sentences to the sentence count input field 21, and presses the setting button 23. In this case, the collation range setting unit 12 retains the collation method selected by the selection button 19 and the collation range (the number of sentences) inputted to the sentence count input field 21.

A further assumption is that the user chooses the selection button 20 (a button for specifying the [collation based on the time]), then inputs the time information (on the unit of minute) to the time input field 22, and presses the setting button 23. In this case, the collation range setting unit 12 retains the collation method selected by the selection button 20 and the collation range (time) inputted to the time input field 22.

Figure 3:
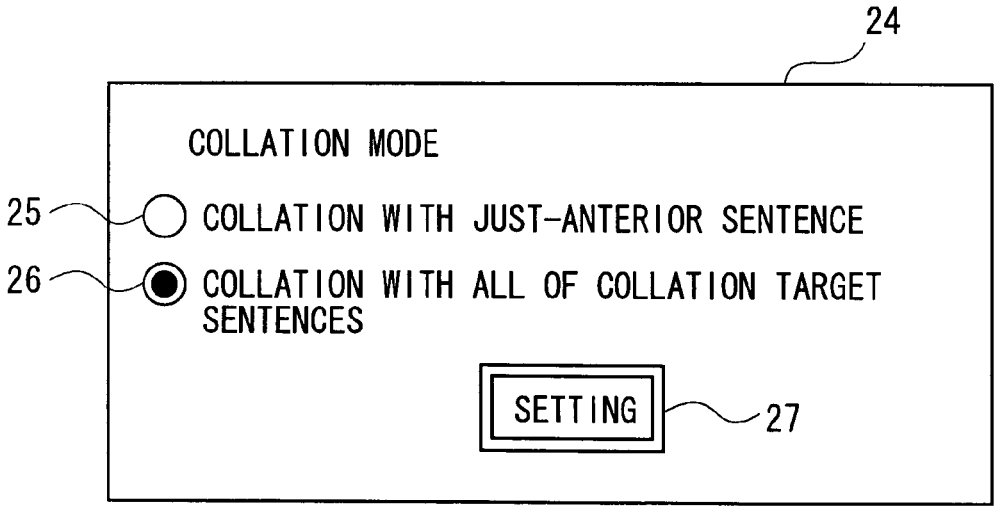
FIG. 3 is a diagram showing a collation mode setting window according to the embodiment of the present invention.

FIG. 3 shows a collation mode setting window 24 for setting the collation mode. The collation mode setting window 24 has a selection button 25, a selection button 26 and a setting button 27.

It is assumed that the user chooses the selection button 25 (a button for specifying the mode of the [collation with just-anterior sentence] (the first collation mode) as the collation mode), and selects the setting button 27. In this case, the collation mode setting unit 13 retains the selected collation mode (the first collation mode) as the collation mode executed in the speech synthesizer 1.

It is further assumed that the user chooses the selection button 26 (a button for specifying the mode of the [collation with all of collation target sentences] (the second collation mode) as the collation mode) and selects the setting button 27. In this case, the collation mode setting unit 13 retains the selected collation mode (the second collation mode) as the collection mode to be executed in the speech synthesizer 1.

Figure 4:
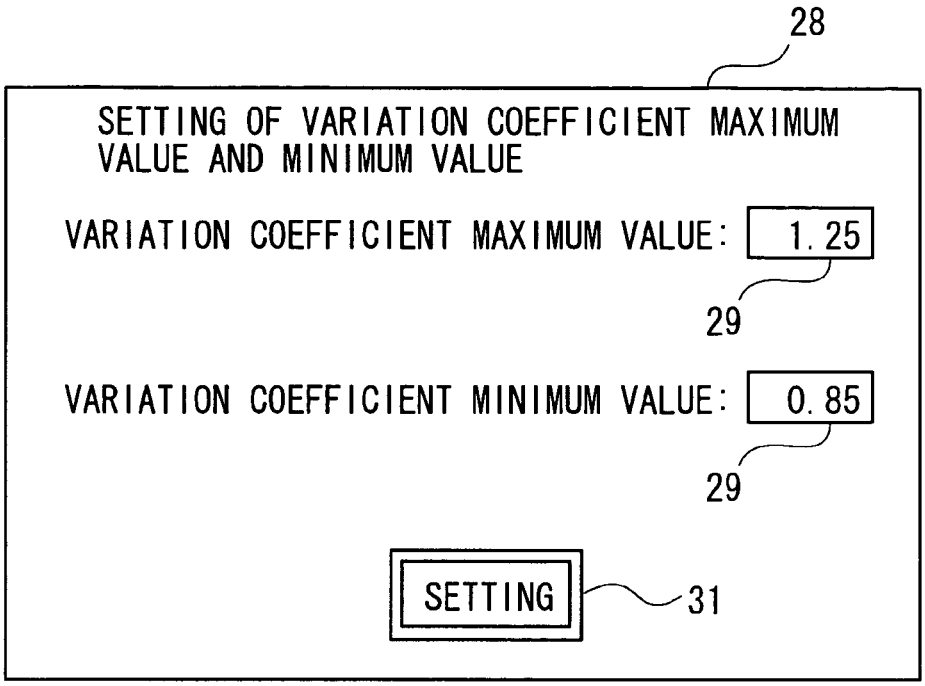
FIG. 4 is a diagram showing a variation coefficient maximum value/minimum value setting window according to the embodiment of the present invention.

FIG. 4 illustrates a variation coefficient maximum value/minimum value setting window 28 for setting the maximum value and the minimum value of the variation coefficient. The variation coefficient maximum value/minimum value setting window 28 is set up by the variation coefficient maximum value/minimum value setting unit 15 so as to be displayed on the display device (unillustrated) connected to the variation coefficient maximum value/minimum value setting unit 15. Further, the variation coefficient maximum value/minimum value setting unit 15 accepts an input, given by the user, to the variation coefficient maximum value/minimum value setting window 28 through the input device (not shown) connected to the variation coefficient maximum value/minimum value setting unit 15.

The variation coefficient maximum value/minimum value setting window 28 has a variation coefficient maximum value input field 29, a variation coefficient minimum value input field 30 and a setting button 31. An assumption is that the user inputs numerical values to the variation coefficient maximum value input field 29 and to the variation coefficient minimum value input field 30, and selects the setting button 31. Then, the variation coefficient maximum value/minimum value setting unit 15 retains the value inputted to the variation coefficient maximum value input field 29 as the variation coefficient maximum value used in the speech synthesizer 1. Further, the variation coefficient maximum value/minimum value setting unit 15 sets, as the variation coefficient minimum value, the value inputted to the variation coefficient minimum input field 30 in the reading text information accumulation unit 11.

It should be noted that common values are set as the speed coefficient, the pitch coefficient, and the maximum value and the minimum value of the volume coefficient in the setting unit 15 in the present embodiment. Such a scheme may, however, be applied that the maximum value and the minimum value are prepared for every type of coefficient.

Figure 5:
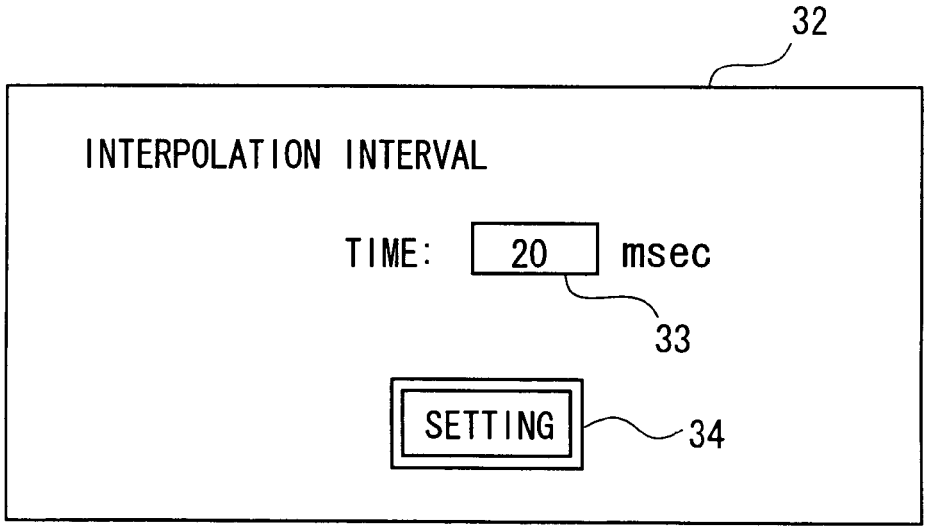
FIG. 5 is a diagram showing an interpolation interval setting window according to the embodiment of the present invention.

FIG. 5 shows an interpolation interval setting window 32. The interpolation interval setting window 32 has an interpolation interval input field 33 and a setting button 34. It is assumed that the user inputs a numerical value to the interpolation interval input field 33, and selects the setting button 34. In this case, the interpolation interval setting unit 16 retains the numerical value, as an interpolation interval, inputted to the interpolation interval input field 33.

Collation Mode

Next, the mode of the [collation with just-anterior sentence](the first collation mode) and the mode of the [collation with all of collation target sentences] (the second collation mode) will be each explained as the collation mode.

Figure 6:
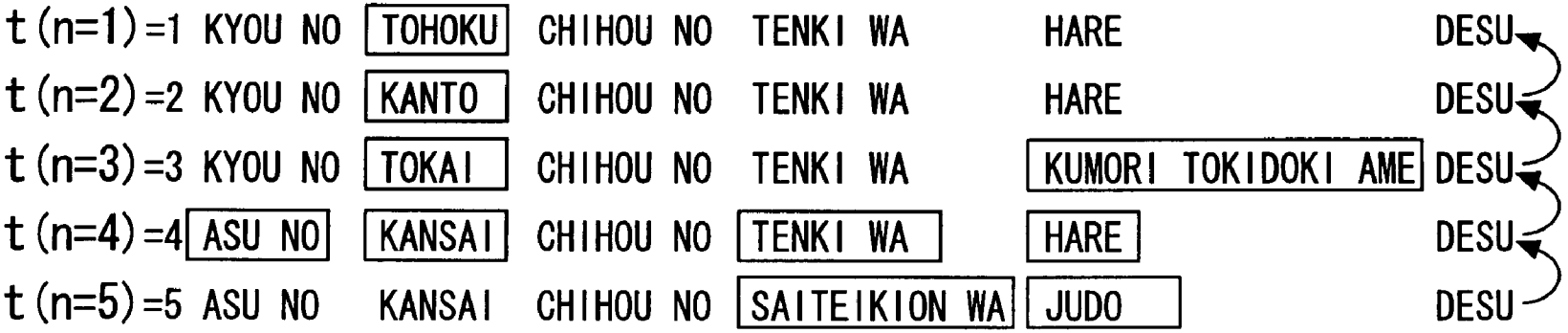
FIG. 6 is an explanatory diagram of the mode of [collation with just-anterior sentence] according to the embodiment of the present invention.

FIG. 6 is an explanatory diagram of the first collation mode. FIG. 6 shows an example of the text (sentence) converted into the phonogram string by the linguistic processing unit 4. The phonogram string shown in FIG. 6 is, for giving easy-to-see orthography, written not in alphabets but in Japanese in a way that removes accent symbols etc. Further, FIG. 6 illustrates past sentences (t=1, t=2, t=3, t=4) read from the accumulation unit 11 in accordance with the collation range (e.g., [the number of sentence=4]) and a new sentence (synthetic speech generation target sentence: t=5) inputted newly to the text collation unit 9.

It should be noted that before accumulating the new sentence in the accumulation unit 11, one or more past sentences, which should be collated with the new sentence, are read from the accumulation unit 11, and, after executing the collation process, the new sentence is accumulated in the accumulation unit 11 in the present embodiment. As a substitute for this scheme, such a scheme may also be adopted that the new sentence is temporarily accumulated in the accumulation unit 11 and is read out in the collation process. In FIG. 6, a variable n corresponds to a numeral for designating each sentence. For example, "n=1" corresponds to the numeral for specifying a sentence of [Today's weather in the Tohoku region is fair.] ([kyou no tohoku chihou no tenki wa hare desu]), and "n=2" corresponds to the numeral for specifying a sentence of [Today's weather in the Kanto region is fair.] ([kyou no kanto chihou no tenki wa hare desu]). "n=5" corresponds to a sentence of [The tomorrow's lowest temperature in the Kansai region is 10 degrees.] ([asu no kansai chihou no saitei kionn wa juudo desu.]), and this sentence, in the example in FIG. 6, is shown as a sentence inputted afresh to the speech correction unit 2 (the speech synthesizer 1).

A variable t(n) represents the input or accumulation time assigned to the sentence specified by the variable n. For instance, t(1) represents the time when the sentence of [Today's weather in the Tohoku region is fair.] ([kyou no tohoku chihou no tenki wa hare desu]) is inputted or accumulated.

A variable b is a numeral specifying, in the case of segmenting each sentence to be collated into a plurality of parts, a position of each part. Each sentence to be collated is segmented into the plurality of parts according to the same predetermined rule. For example, in the present embodiment, the sentence is segmented into the plurality of phrases (parts) through the morphological analysis. In the example shown in FIG. 6, each of five sentences is segmented into six phrases (parts). In FIG. 6, for example, "b=1" specifies words (phrases) such as [today's] ([kyou no]), [today's] ([kyou no]), [today's] ([kyou no]), [tomorrow's] ([asu no]) and [tomorrow's] ([asu no]). Further, "b=2" specifies words such as [Tohoku], [Kanto], [Tokai], [Kansai] and [Kansai].

Thus, the phrase is designated by n and b. Let a(n, b) be this phrase. In this case, for example, a(1, 2) represents [Tohoku], and a(2, 2) represents [Kanto]. The collation unit 14 compares, as the collation process, two sets of a(n, b) having the same value of the variable b and different values of the variable n. The collation unit 14, in the process of the collation between a(1, 1) ([today's]) ([kyou no]) and a(2, 1) ([today's]) ([kyou no]), judges that contents of the phrases are the same. Moreover, the collation unit 14, in the collation between a(1, 2) ([Tohoku]) and a(2, 2) ([Kanto]), judges that the contents of the phrases are different.

The collation unit 14, in the first collation mode, collates two sets of a (n, b) of which b is the same and n is anterior by one in position as in the case of the collation between a(5, b) indicating the sentence (the new sentence) of n=5 and a(4, b) indicating the sentence of n=4 and the collation between a(4, b) indicating the sentence of n=4 and a(3, b) indicating the sentence of n=3.

FIG. 7 is an explanatory diagram of the mode of the [collation with all of collation target sentences] (the second collation mode). In the second collation mode, the collation unit 14 collates the sentence specified by n=5 shown in FIG. 7 with all of the remaining sentences (corresponding to n=1, 2, 3, 4) acquired for the collation from the accumulation unit 11.

EXAMPLE OF CALCULATION OF VARIATION DEGREE

The collation unit 14 calculates the variation degree of the new sentence from the past sentence through the collation corresponding to the collation mode described above.

First Calculation Example

FIG. 8 is a diagram showing a calculation example (a first calculation example) of calculating a variation degree and a variation coefficient in a case where the collation range is defined by [the number of sentences=5] and the collation mode is the first collation mode.

A variable v(n, b) shown in FIG. 8 represents a variation degree in every position (segmenting position) b. The variation degree v(n, b) is given by the following mathematical expression (1).

[Mathematical Expression 1] (1)

$$v(n, b) = \sum_{m=1}^{n} \frac{1 - \delta(a(m, b), a(m-1, b))}{t(n) - t(m) + 1}$$

In the mathematical expression (1), a(0, b)=a(1, b). Further, in the mathematical expression (1), δ(a(m, b), a(m−1, b)) represents "1" when a(m, b) is equal to a(m−1, b) and represents "0" when a(m, b) is not equal to a(m−1, b). For instance, when a new sentence designated by "5" as a value of the variable n is inputted, the variation degree in each position b is calculated based on v(5, b). For example, v(5,1) is given such as ½, i.e., 0.5. Further, v(5, 2) is given by (¼)+(⅓)+(½), which is approximately 1.08. Thus, the variation degree in each position b is calculated.

By contrast, in the case of setting the mode of [collation with all of collation target sentences] (the second collation mode) as the collation mode, a variation degree x(n, b) is calculated in the following mathematical expression (2).

[Mathematical Expression 2] (2)

$$x(n, b) = \sum_{m=1}^{n-1} \frac{1 - \delta(a(m, b), a(n, b))}{t(n) - t(m)}$$

In a mathematical expression (2), one of functions "a" within a function "δ" contained in the mathematical expression (1) is a(n, b). The function "a(n, b)" represents a phrase in the new sentence. Hence, the mathematical expression (2) is an expression for calculating the variation degree, wherein the collation mode is the mode of the [collation with all of collation target sentences].

Second Calculation Example

FIG. 9 is a diagram showing a calculation example (a second calculation example) of calculating a variation degree and a variation coefficient in a case where the collation range is [5 min] and the collation mode is the second collation mode. FIG. 9 shows a case wherein a 5-min range tracing the sentences back from when inputting a new sentence contains the sentences corresponding to n=1 through 4 ("n=4" represents the new sentence).

A calculation example of calculating the variation coefficient in the [collation based on the time] will be explained. The collation based on the time is the collation about the sentences outputted (read) within a preset time range. FIG. 9 shows a case in which the second collation mode is selected. A variable y(n, b) shown in FIG. 9 represents a variation degree in each phrase (position b). The variation degree y(n, b) is given by the following mathematical expression (3).

[Mathematical Expression 3] (3)

$$y(n, b) = \sum_{m=1}^{n-1} \left(T - \frac{t(n) - t(m)}{T}\right)(1 - \delta(a(m, b), a(n, b)))$$

In the mathematical expression (3), "T" represents the time set by the collation range setting unit 12. In FIG. 9, the sentence specified by n=4 is a sentence (a synthetic speech generation target sentence) that is newest in those inputted to the speech synthesizer 1. "t(n)−t(m)" indicates a time difference in terms of sentence reading time.

By contrast, when the first collation mode is set as the collation mode, a variation degree z(n, b) of each position b is calculated according to the following mathematical expression (4).

[Mathematical Expression 4] (4)

$$z(n, b) = \sum_{m=1}^{n} \left(T - \frac{t(n) - t(m)}{T}\right)(1 - \delta(a(m, b), a(m-1, b)))$$

Calculation of Variation Coefficient

Next, the calculation of the variation coefficient by the calculation unit 17 will be explained. The calculation unit 17 calculates the variation coefficient by the same method irrespective of combinations of the collation ranges and the collation modes (v, x, y, z). The variation coefficient consists of the speed coefficient for correcting the phoneme length, the pitch coefficient for correcting the pitch pattern and the volume coefficient for correcting the volume, wherein the speed coefficient is calculated by use of the following mathematical expression (5), the pitch coefficient is calculated by use of the following mathematical expression (6), and the volume coefficient is calculated by employing the following mathematical expression (7).

[Mathematical Expression 5] (5)

$$C1(n, b) = \frac{v(n, b)ge(\mathrm{MIN})}{f \sum_{b=1} v(n, b)}$$

[Mathematical Expression 6] (6)

$$C2(n, b) = \frac{v(n, b)ge(\mathrm{MIN})}{f \sum_{b=1} v(n, b)}$$

[Mathematical Expression 7] (7)

$$C3(n, b) = \frac{v(n, b)ge(\mathrm{MIN})}{f \sum_{b=1} v(n, b)}$$

As shown in the mathematical expressions (5)-(7), the speed coefficient, the pitch coefficient and the volume coefficient are calculated by using the same mathematical expression. Namely, the mathematical expression common to the phoneme length, the pitch and the volume is prepared as the calculation formula for calculating the variation coefficient. Calculation formulae different for every type of the variation coefficient can, however, be prepared. Further, in the mathematical expressions (5)-(7), v(n, b) is given as the variation degree, however, x(n, b), y(n, b), z(n, b) are given in place of v(n, b) in accordance with the calculation method for calculating the variation degree.

The calculation unit 17 calculates, for every position b (phrase), a speed coefficient C1(n, b), a pitch coefficient C2(n, b) and a volume coefficient C3(n, b) from a variation degree, a normal sentence length g (a length of the sentence collated), a preset coefficient minimum value e(MIN), a sum of the positions b contained in the variation degree and a preset normal phoneme length f (a phoneme length of b).

The calculation unit 17 previously has the coefficient minimum value e(MIN) and the normal phoneme length f. The normal sentence length g can be received together with the variation degree from, e.g., the collation unit 14. Further, the calculation unit 17 can acquire the coefficient minimum value e(MIN), the normal phoneme length f and the normal sentence length g (which are stored in the accumulation unit 11 by the text collation unit 9) by reading these values from the accumulation unit 11.

Moreover, the variation coefficient is given a variation coefficient maximum value d(MAX) (which is 1.25 designated by the user in the present embodiment) and a variation coefficient minimum value d(MIN) (which is 0.85 designated by the user in the present embodiment), respectively. If the calculated variation coefficient is smaller than the variation coefficient minimum value d(MIN), the variation coefficient minimum value d(MIN) is adopted as a result of the calculation of the variation coefficient. Whereas if the calculated variation coefficient is larger than the variation coefficient maximum value d(MAX), the variation coefficient maximum value d(MAX) is adopted as a result of the calculation thereof.

FIG. 8 shows a value calculated, as the variation coefficient (the speed coefficient C1) for every phrase, by the calculation unit 17 using the mathematical expression (5). For instance, the speed coefficient C1(5, 1) is 0.95. Further, the speed coefficient C1(5, 3) becomes 0.85 from the mathematical expression (5) and from the minimum value d(MIN). Further, FIG. 9 shows a value calculated by using the mathematical expression (5) as the variation coefficient (the speed coefficient C1) for every phrase.

Operational Example

Figure 10:
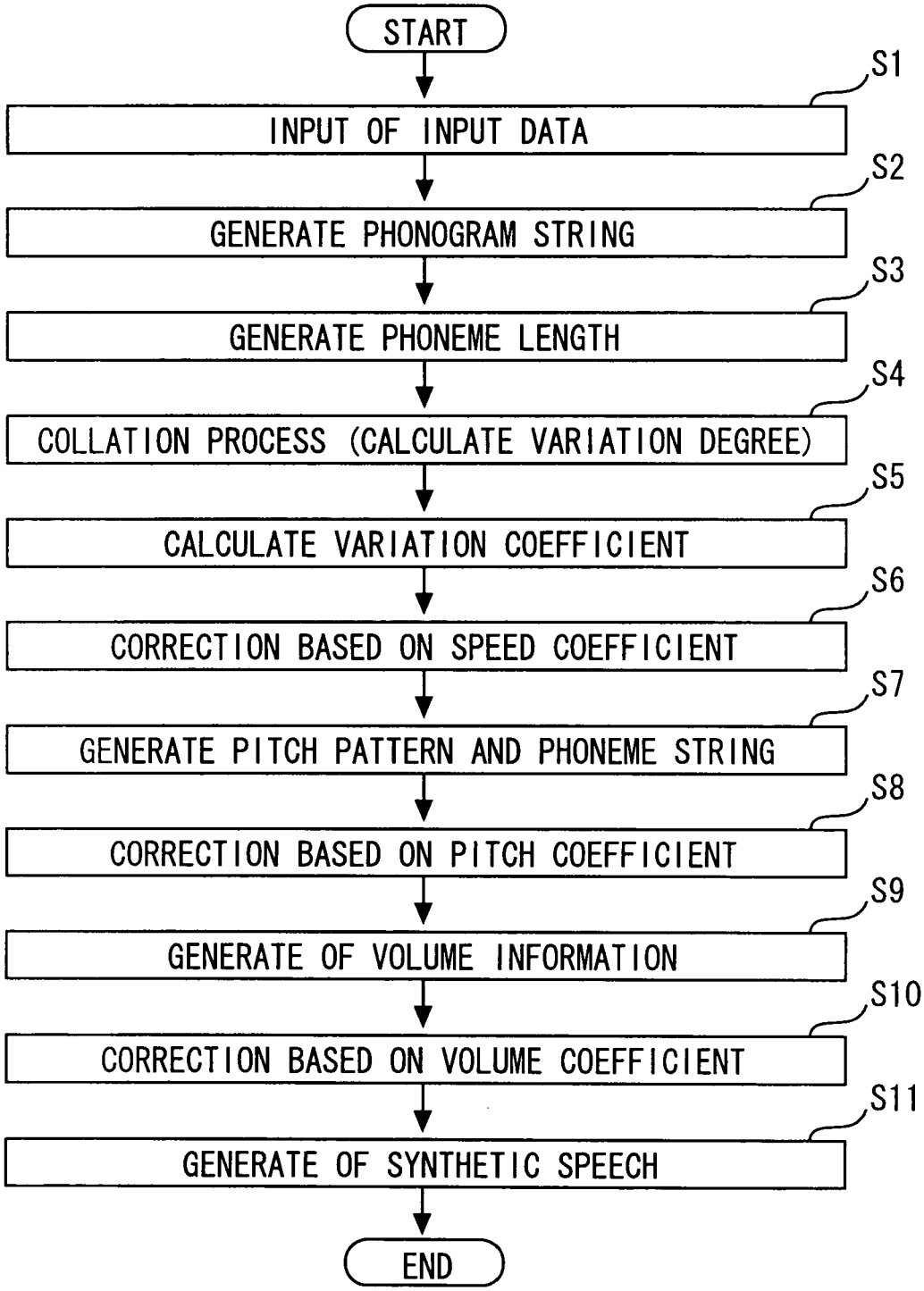
FIG. 10 is a flowchart showing a process in the speech synthesizer in the embodiment of the present invention.

FIG. 10 is a flowchart showing an operating example (processing example) of the speech synthesizer 1. When a power source of the speech synthesizer 1 is switched ON, the central processing unit (CPU) provided in the speech synthesizer 1 reads a program for generating the synthetic speech from the hard disc (storage device), then loads the program into the memory and executes the program. Through this operation, a process shown in FIG. 10 comes to a start-enabled status. The start of the process shown in FIG. 10 is triggered by inputting the text data for generating the synthetic speech to the input unit 3.

The input unit 3 receives the input of the new text data for generating the synthetic speech from the input device (unillustrated) operated by the user (step S1). The input unit 3 inputs the text data to the linguistic processing unit 4.

The linguistic processing unit 4 generates the phonogram string from the text data inputted from the input unit 3 (step S2). The linguistic processing unit 4 outputs the phonogram string to the phoneme length generation unit 5 and to the text collation unit 9.

For example, it is assumed that the text data of the sentence [Tomorrow's weather in the Kansai region is fair.] ([asu no kansai chihou no tenki wa hare desu.]) is inputted to the linguistic processing unit 4 from the input unit 3. The linguistic processing unit 4 generates a phonogram string such as [a:su:no:ka:n:sa:i:chiho:u:no/te:n:ki:wa=ha:re2de:su.] from the inputted text data.

The phoneme length generation unit 5 generates a phoneme length out of the phonogram string inputted from the linguistic processing unit 4 (step S3). The phoneme length generation unit 5 determines the phoneme length (normal phoneme length) corresponding to the respective phonemes structuring the phonogram string.

In the text collation unit 9, when a new phonogram string (a new sentence) is inputted from the linguistic processing unit 4, the collation unit 14 executes the collation process (step S4). In the collation process, the collation unit 14, at first, determines the collation range. Namely, the collation unit 14 reads, from the accumulation unit 11, one or more sentences (past sentences: collation target sentences) that should be collated with the new sentence according to the collation range retained (set) by the collation range setting unit 12.

For instance, if the collation range is set such as [the number of sentences=4], the collation unit 14 reads the four sentences from the accumulation unit 11. Further, if the collation range is designated by [1 min], the collation unit 14 reads from the accumulation unit 11 the past sentences uttered within one minute from the present point of time.

Next, the collation unit 14 executes, based on the collation mode retained (set) by the collation mode setting unit 13, the collations among the sentences including the new sentence and the past sentences read out of the accumulation unit 11, thereby calculating the variation degree for every phrase.

The collation unit 14 outputs the thus-calculated variation degree to the coefficient calculation unit 10. At this time, the collation unit 14 obtains a length of the collation target sentence and registers this length as a sentence length g in the accumulation unit 11. Further, the collation unit 14 registers the new sentence in the accumulation unit 11.

In the coefficient calculation unit 10, the calculation unit 17, when receiving the variation degree from the collation unit 14, obtains the maximum value and the minimum value of the variation coefficient (which are retained by the setting unit 15) from the setting unit 15, and reads the normal sentence length g, the normal phoneme length f and the coefficient minimum value e(MIN) from the accumulation unit 11. The calculation unit 17 calculates the variation coefficient from the variation degree, the variation coefficient maximum value, the variation coefficient minimum value, the normal sentence length, the normal phoneme length and the coefficient minimum value (step S5). The variation coefficient is assigned as a speed coefficient to the phoneme length generation unit 5. Further, the variation coefficient is assigned as a pitch coefficient to the pitch generation unit 6. Moreover, the variation coefficient is assigned as a volume coefficient to the volume generation unit 7.

At this time, the phoneme length generation unit 5 corrects the phoneme length with the speed coefficient (the variation coefficient) obtained from the coefficient calculation unit 10 (the calculation unit 17) (the phrase containing the variation is weighted by the speed coefficient) (step S6). For example, the phoneme length generation unit 5, when the phoneme length of a certain phoneme is 40 and the speed coefficient is 1.2, calculates a new phoneme length as 48. Namely, the phoneme length generation unit 5 corrects the phoneme length in a way that multiplies the normal phoneme length of each of the phonemes structuring the phrase by the speed coefficient calculated for this phrase. Thereafter, the phoneme length generation unit 5 outputs the phonogram string and the phoneme length to the pitch generation unit 6.

Figures 11, 12:
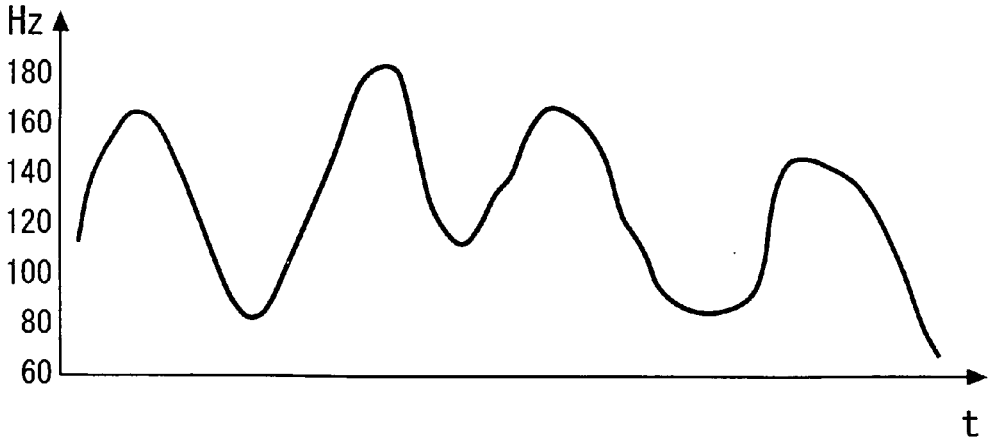
FIG. 11 is a table showing an example of data for generating the synthetic speech according to the embodiment of the present invention.
FIG. 12 is a table showing a pitch pattern according to the embodiment of the present invention.

The pitch generation unit 6 generates a phoneme string and a pitch pattern from the phonogram string and the phoneme length that are inputted from the phoneme length generation unit 5 (step S7). FIG. 12 illustrates an example of a pitch frequency. Herein, the axis of ordinate represents a pitch (pitch frequency), and the axis of abscissa represents the time. The pitch generation unit 6 has data for determining the pitch frequency corresponding to the phoneme, and generates the pitch frequency (a normal pitch frequency) on the basis of this data. The pitch generation unit 6 corrects (weights) the normal pitch frequency with the pitch coefficient obtained from the coefficient calculation unit 10 (step S8). For instance, when the pitch frequency at a certain point of time is 160 [Hz] and the pitch coefficient is 0.9, the pitch generation unit 6 obtains 144 [Hz] that is a new pitch frequency corrected by multiplying the pitch frequency (160 [Hz]) by the pitch frequency (0.9). The pitch generation unit 6 outputs the phoneme length, the pitch pattern (generated by combining the pitch frequencies of the each phoneme) and the phoneme string to the volume generation unit 7.

The volume generation unit 7 generates volume information from the pitch pattern and the phoneme string that are inputted from the pitch generation unit 6 (step S9). The volume generation unit 7 determines the volume (a normal volume) for each phoneme of the new sentence from the pitch pattern and from the phoneme string. Subsequently, the volume generation unit 7 multiples the normal volume by a volume coefficient obtained from the coefficient calculation unit 10 (the calculation unit 17), thereby correcting the volume (step S10). Namely, the volume generation unit 7 calculates a corrected volume value by multiplying the determined volume value for each phoneme structuring the phrase by a corresponding volume coefficient calculated for every phrase. Such a process is executed for every phoneme. The volume generation unit 7 outputs the phoneme length, the pitch pattern, the phoneme string and the volume information to the waveform generation unit 8.

FIG. 11 shows part of data for generating the synthetic speech that is sent to the waveform generation unit 8. FIG. 11 shows a phoneme name, a phoneme length associated with the phoneme name and volume information (a relative value with respect to the volume) associated with the phoneme name. FIG. 11 shows sets of data outputted as a synthetic speech in the sequence from above. In FIG. 11, "Q" indicates a silence interval (SP (Short Pause)). The synthetic speech is generated by the phoneme string, the phone length, the volume information and the pitch pattern shown in FIG. 12.

The waveform generation unit 8 generates the synthetic speech from the phoneme string, the phoneme length, the pitch pattern and the volume information, which are inputted from the volume information generation unit 7 (step S11). The waveform generation unit 8 outputs the thus-generated synthetic speech to the voice output device (not shown) such as the speaker connected to the speech synthesizer 1.

Interpolation Interval

The phoneme length generation unit 5, the pitch generation unit 6 and the volume generation unit 7 described above, if an interpolation interval is retained (set) by the interpolation interval setting unit 16 of the coefficient calculation unit 10, sets the interpolation interval into the new sentence as the necessity may arise so that the speed, the pitch and the volume gently change in this interpolation interval.

Namely, when the interpolation interval (e.g., 20 [msec]) is set in an interpolation interval 16, the phoneme length generation unit 5, the pitch generation unit 6 and the volume generation unit 7 are notified of information showing a length of this interpolation interval. The phoneme length generation unit 5, if a change occurs in the variation coefficient between a certain phrase and a phrase subsequent (subsequent phrase) to the certain phrase (if the variation coefficient is different), judges whether the silence interval exists in between these phrases or not, then sets the interpolation interval, e.g., in front of the subsequent phrase if none of the silence interval exists, and adjusts the variation coefficient (speed coefficient) so that the speed (a speed of the speech) of the synthetic speech gently changes within this interpolation interval.

To be specific, for example, the speed coefficient is made to gently change by multiplying the speed coefficient calculated for the subsequent phrase by a window function such as a Hanning window. With this contrivance, the phoneme length of each phoneme contained in the interpolation interval gently changes corresponding to the speed coefficient.

Figure 13A:
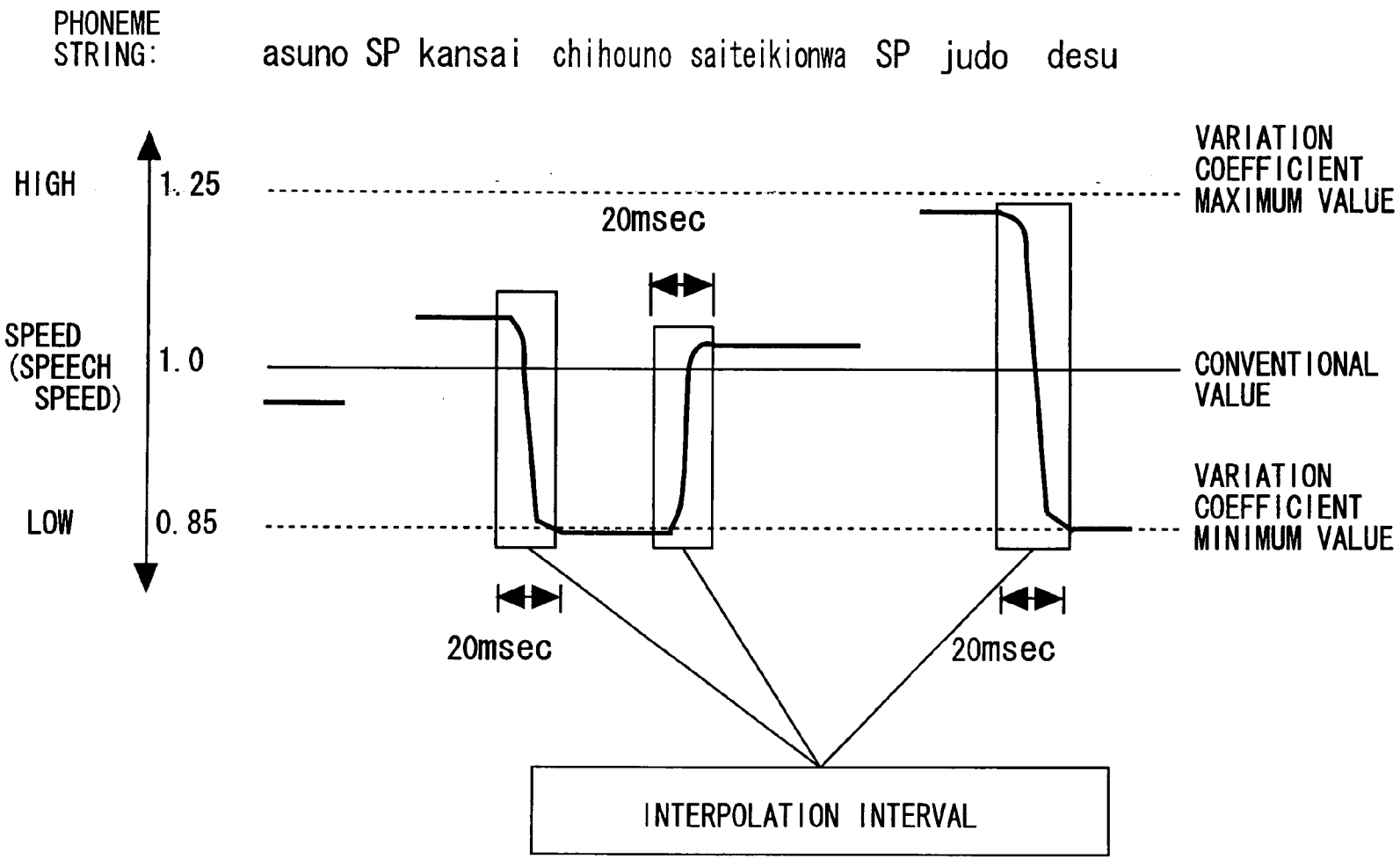
FIG. 13A is an explanatory diagram showing a speed coefficient according to the embodiment of the present invention.

FIG. 13A is a graph showing an example of adjusting the speed coefficient as the variation coefficient. FIG. 13A shows the example of executing the correction based on the speed coefficient and adjusting the speed coefficient by use of the interpolation interval and the window function with respect to the phoneme string such as [asuno SP(silence interval) kansai chihouno saiteikionwa SP(silence interval) judo desu]([The tomorrow's SP (Short Pause) lowest temperature in the Kansai region is SP (Short Pause) 10 degrees]). In FIG. 13A, the speed (an original value) of the phoneme string is set to 1.0 in the case of executing none of the correction based on the speed coefficient.

Further, in the example shown in FIG. 13A, the speed coefficient for the phrase [asuno] (the tomorrow's) is 0.95, the speed coefficient for the phrase [kansai] (the Kansai) is 1.08, the speed coefficient for the phrase [chihouno] (region) is 0.85, the speed coefficient for the phrase [saiteikionwa] (the lowest temperature) is 1.06, the speed coefficient for the phrase [judo] (10 degrees) is 1.25, and the speed coefficient for the phrase [desu] (is) is 0.85.

Herein, the speed coefficients for the phrase [kansai] (Kansai) and the phrase [chihouno] (region) are 1.08 and 0.85 respectively, and these two values are different (the variation coefficient changes). The silence interval (Short Pause (SP)) does not exist in these phrases.

In this case, the phoneme length generation unit 5 as the adjusting unit sets the interpolation interval "20 [msec]" in between these phrases, and adjusts the speed coefficient in a way that multiplies the speed coefficient by the window function so that the speed coefficient gently changes (decreases) from 1.08 down to 0.85 within this interpolation interval "20 [msec]". Further, the phoneme length generation unit 5 sets the interpolation interval also in between the phrase [chihouno] (region) and the phrase [saiteikionwa] (the lowest temperature), and adjusts the speed coefficient so that the speed coefficient gently changes (increases) from 0.85 up to 1.06 within this interpolation interval. The same speed coefficient adjustment is made between the phrase [judo] (10 degrees) and the phrase [desu] (is).

Figure 13B:
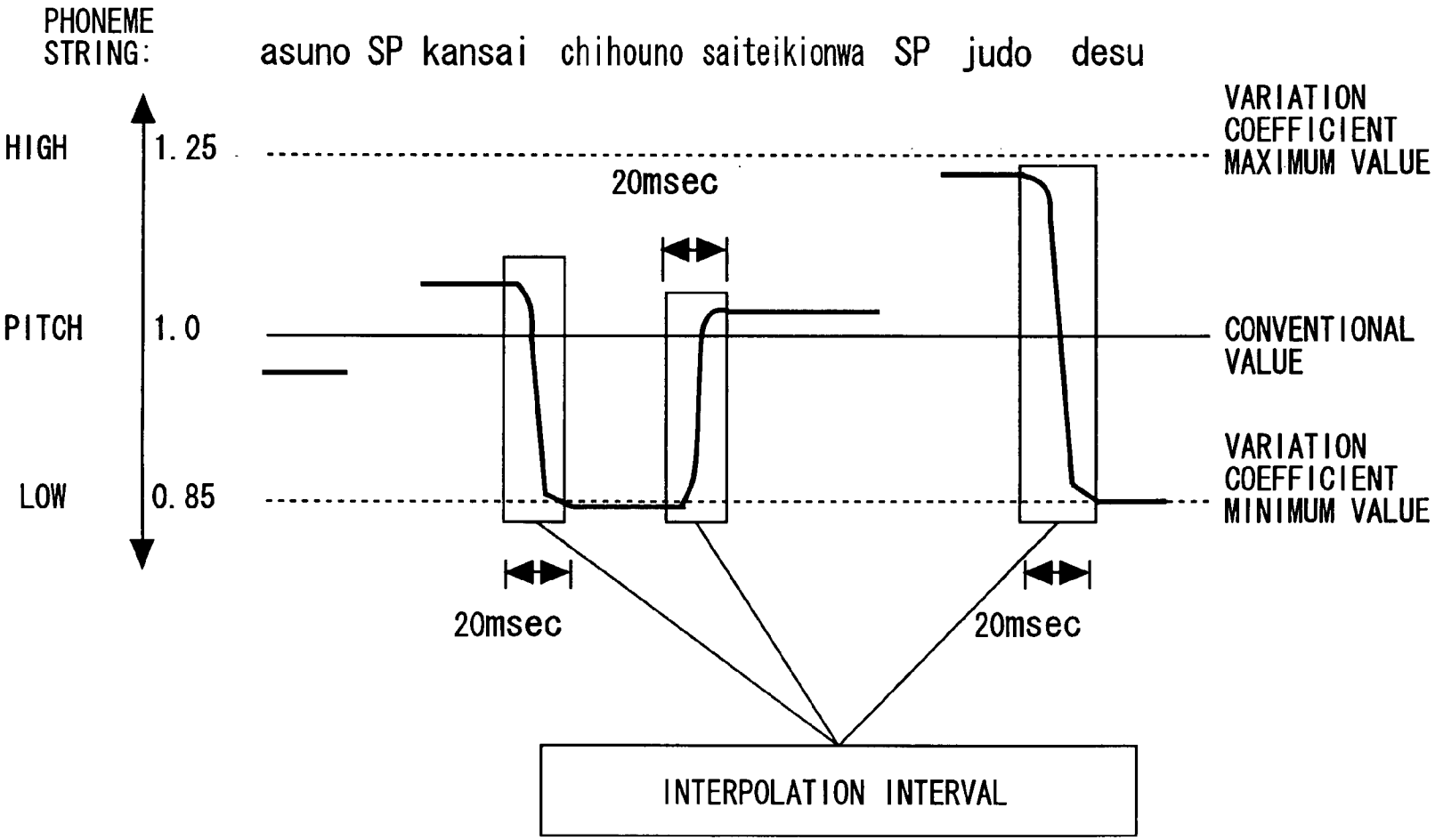
FIG. 13B is an explanatory diagram showing a pitch coefficient according to the embodiment of the present invention.

Moreover, FIG. 13B is a graph showing an example of adjusting the pitch coefficient as the variation coefficient. The speed coefficient, the pitch coefficient and the volume coefficient are calculated in the mathematical expressions (5)-(7), however, in the present embodiment, these mathematical expressions are the same. Accordingly, the pitch coefficient shown in FIG. 13B has the same value as the speed coefficient shown in FIG. 13A has, and the interpolation is executed in the same way with the speed coefficient.

Also in the pitch generation unit 6 and in the volume generation unit 7, the adjustment of the variation coefficient is executed in the same way as in FIG. 13. In these cases, in the description given above, the [speed coefficient] is read by being replaced by the [pitch coefficient] or the [volume coefficient], and the [phoneme length generation unit 5] is read by being replaced by the [pitch generation unit 6] or the [volume generation unit 7].

Note that the operational example described above has dealt with the case in which the variation coefficient is calculated as the speed coefficient, the pitch coefficient and the volume coefficient, and the correction is made in each of the phoneme length generation unit 5, the pitch generation unit 6 and the volume generation unit 7, however, such a scheme may also be taken that at least one of the phoneme length, the pitch and the volume is corrected. Namely, it is not an indispensable requirement for the present invention that the phoneme length, the pitch and the volume be all corrected. Further, it is not an indispensable requirement of the present invention that the variation coefficient in the interpolation interval be adjusted.

Operation and Effect in Embodiment

According to the speech synthesizer (speech synthesizer) explained above, the synthetic speech generation target sentence is collated with the past sentence, and the variation degree between these sentences is calculated. Furthermore, the variation coefficient corresponding to the variation degree is calculated, and the elements (the phoneme length (speed), the pitch frequency, the volume) of the synthetic speech data are corrected with the variation coefficients. The speech speed can be changed by correcting the phoneme length. The pitch can be changed by correcting the pitch. Further, the volume can be changed by correcting the volume.

Moreover, if the variation coefficient changes between the phrases and if no silence interval (short pause) exists between the phrases, the variation coefficient is adjusted so that the variation coefficient gently changes between the phrases.

Based on what has been discussed so far, according to the present embodiment, as in the case of a weather forecast and a voice guidance, when the sentences, though similar in structure but different partially in meaning, are consecutively synthesized and thus outputted, any one or more elements of the speech speed (phoneme length), the pitch and the volume can be changed at the variation degree from the contents uttered so far. Moreover, even in the case of designating the utterance time of the speech, the utterance of the speech can be completed within the (predetermined) time. Further, if the same keyword occurs consecutively in the same sentence, a change can be given to the prosodemes.

Based on what has been discussed so far, it is possible to automatically generate the synthetic speech given the prosodic change in the sentence and exhibiting high naturalness and to restrain a hearer from failing to hear. Namely, it is feasible to provide the speech synthesizer that outputs the easy-to-hear synthetic speech to the hearer.

Modified Example

In the example of the configuration shown in FIG. 1, the phoneme length generation unit 5, the pitch generation unit 6 and the volume generation unit 7 correct the speed coefficient, the pitch coefficient and the volume coefficient, respectively. Namely, the configuration is that the phoneme length generation unit 5, the pitch generation unit 6 and the volume generation unit 7 include the correction unit and the adjusting unit according to the present invention.

Figure 14:
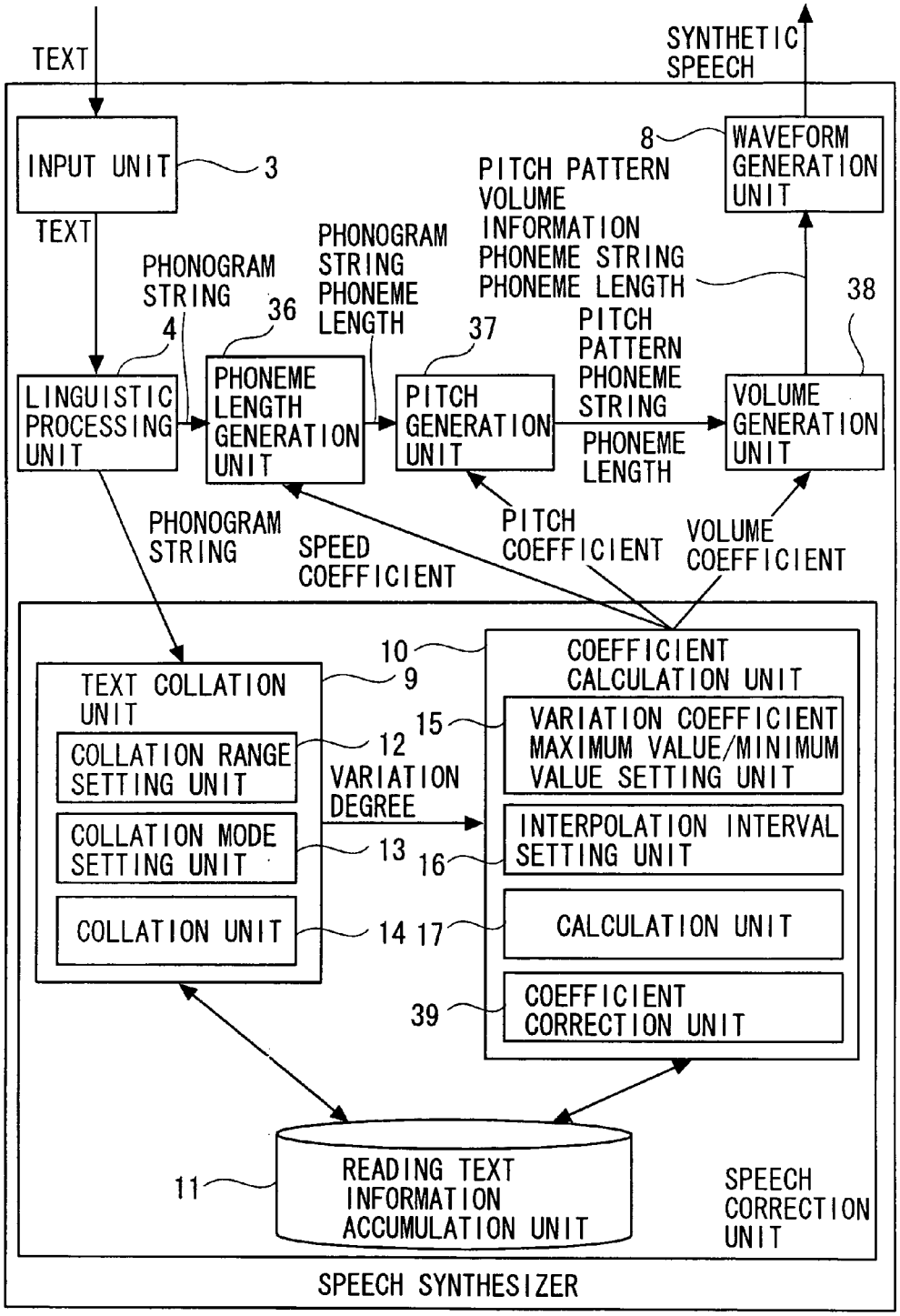
FIG. 14 is a diagram of a basic configuration of the speech synthesizer in a modified example of the present invention.

As depicted in FIG. 14, however, such a configuration may also be applied that the coefficient calculation unit 10 includes a coefficient correction unit 39; a phoneme length generation unit 36, a pitch generation unit 37 and a volume generation unit 38 supply the coefficient correction unit 39 with outputs containing the normal phoneme length, the normal pitch frequency and the normal volume explained in the embodiment discussed above; the coefficient correction unit 39 corrects the phoneme length, the pitch frequency and the volume with the variation coefficients; and further the coefficient correction unit 39 adjusts the variation coefficient in the interpolation interval according to the necessity. Namely, the correction unit and the adjusting unit according to the present invention may be provided on the side of the speech correction unit 2.

Others

The disclosures of Japanese patent application No. JP2006-097331, filed on Mar. 31, 2006 including the specification, drawings and abstract are incorporated herein by reference.

What is claimed is:

1. A speech synthesizer comprising:

an input unit to receive an input of a sentence;

a generation unit to generate synthetic speech data from the sentence inputted to the input unit;

a linguistic processing unit to generate a phonogram string, being segmented into a plurality of segmental parts, from the sentence received by the input unit;

an accumulation unit to accumulate the phonogram string generated by the linguistic processing unit in a recording medium;

a collation unit implemented in a processor to compare, when a new phonogram string is generated by the linguistic processing unit, corresponding segmental parts of the new phonogram string with a collation target phonogram string included in a predetermined range tracing back from the new phonogram string, to assign a predetermined value to one or more segmental parts of which the new phonogram string and the collation target phonogram string does not matches, and to calculate, with respect to each of the plurality of segmental parts, a variation degree of the new phonogram string from the collation target phonogram string based on predetermined values assigned to the one or more segmental parts;

a calculation unit to calculate a variation coefficient for each of the plurality of segmental parts in the new phonogram string based on the variation degree of each of the plurality of segmental parts in the new phonogram string calculated by the collation unit, a normal sentence length of the new phonogram, a preset normal phoneme length of each of the plurality of segmental parts in the new phonogram string, and a preset coefficient minimum value; and a correction unit to correct the synthetic speech data with the variation coefficient.

2. The speech synthesizer according to claim 1, wherein the collation unit makes the collation between the phonogram strings belonging to a predetermined collation range.

3. The speech synthesizer according to claim 2, wherein the collation unit makes the collation between a predetermined number of phonogram strings.

4. The speech synthesizer according to claim 2, wherein the collation unit makes the collation between the phonogram strings contained in a predetermined time range.

5. The speech synthesizer according to claim 1, wherein the collation unit makes the collation between at least the new phonogram string and a phonogram string generated just anterior to this new phonogram string.

6. The speech synthesizer according to claim 1, wherein the collation unit collates, when a plurality of phonogram strings are acquired as the collation target phonogram strings from the accumulation unit, the new phonogram string with the plurality of phonogram strings, respectively.

7. The speech synthesizer according to claim 1, wherein the correction unit corrects a phoneme length of the sentence inputted to the input unit with the variation coefficient.

8. The speech synthesizer according to claim 1, wherein the correction unit corrects a pitch pattern of the sentence inputted to the input unit with the variation coefficient.

9. The speech synthesizer according to claim 1, wherein the correction unit corrects a volume of the sentence inputted to the input unit with the variation coefficient.

10. The speech synthesizer according to claim 1, further comprising an adjusting unit to set, if a change occurs in the variation coefficient between a certain segmental part of the new phonogram string and a segmental part subsequent to the certain segmental part and when there is no silence interval between these segmental parts, an interpolation interval, and to adjust the variation coefficient so that a variation coefficient corresponding to the certain segmental part gently changes to a variation coefficient corresponding to the subsequent segmental part.

11. The speech synthesizer according to claim 1, further comprising a phoneme length generation unit to generate the phoneme length from the new phonogram string.

12. The speech synthesizer according to claim 1, further comprising a pitch generation unit to generate a pitch pattern from the new phonogram string.

13. A non-transitory computer readable medium storing a program for causing a computer to at least execute:

generating synthetic speech data from a sentence inputted to an input unit;

generating a phonogram string, being segmented into a plurality of segmental parts, from the sentence;

comparing, when a new phonogram string is generated by a linguistic processing unit, corresponding segmental parts of the new phonogram string with a collation target phonogram string included in a predetermined range tracing back from the new phonogram string;

assigning a predetermined value to one or more segmental parts of which the new phonogram string and the collation target phonogram string does not matches;

calculating, with respect to each of the plurality of segmental parts, a variation degree of the new phonogram string from the collation target phonogram string based on predetermined values assigned to the one or more segmental parts;

calculating a variation coefficient for each of the plurality of segmental parts in the new phonogram string based on the calculated variation degree of each of the plurality of segmental parts in the new phonogram string, a normal sentence length of the new phonogram, a preset normal phoneme length of each of the plurality of segmental parts in the new phonogram string and, a preset coefficient minimum value; and correcting the synthetic speech data with the variation coefficient.

* * * * *